US009960475B2

(12) United States Patent
Chen et al.

(10) Patent No.: US 9,960,475 B2
(45) Date of Patent: May 1, 2018

(54) LED LIGHTING DEVICE AND SYSTEM, AND ANTENNA ARRANGEMENT METHOD

(71) Applicant: SENGLED OPTOELECTRONICS CO., LTD., Tongxiang (CN)

(72) Inventors: Xiaofei Chen, Tongxiang (CN); Xingming Deng, Tongxiang (CN); Jinxiang Shen, Tongxiang (CN)

(73) Assignee: SENGLED OPTOELECTRONICS CO., LTD., Tongxiang (CN)

( * ) Notice: Subject to any disclaimer, the term of this patent is extended or adjusted under 35 U.S.C. 154(b) by 107 days.

(21) Appl. No.: 15/027,083

(22) PCT Filed: Oct. 28, 2015

(86) PCT No.: PCT/CN2015/093000

§ 371 (c)(1),
(2) Date: Apr. 4, 2016

(87) PCT Pub. No.: WO2016/101699

PCT Pub. Date: Jun. 30, 2016

(65) Prior Publication Data

US 2016/0329624 A1 Nov. 10, 2016

(30) Foreign Application Priority Data

Dec. 26, 2014 (CN) ..... 2014 1 0829527

(51) Int. Cl.
*H01Q 1/22* (2006.01)
*F21V 3/00* (2015.01)
(Continued)

(52) U.S. Cl.
CPC ..... *H01Q 1/22* (2013.01); *F21K 9/232* (2016.08); *F21K 9/237* (2016.08); *F21K 9/238* (2016.08);
(Continued)

(58) Field of Classification Search
CPC ..... H05B 37/0245; H05B 37/0272; F21V 29/006
See application file for complete search history.

(56) References Cited

U.S. PATENT DOCUMENTS

2012/0044713 A1 2/2012 Chiang et al.
2012/0274208 A1* 11/2012 Chen ..... H01Q 1/38 315/34
(Continued)

FOREIGN PATENT DOCUMENTS

CN 103883908 A 6/2014
CN 103912810 A 7/2014
(Continued)

OTHER PUBLICATIONS

The World Intellectual Property Organization (WIPO) International Search Report for PCT/CN2015/093000 dated Jan. 14, 2016.

*Primary Examiner* — Douglas W Owens
*Assistant Examiner* — Pedro C Fernandez
(74) *Attorney, Agent, or Firm* — Anova Law Group, PLLC

(57) ABSTRACT

A light emitting diode (LED) lighting device is provided. The device includes an LED light source assembly installed on the top of a heat sink body, and an LED driving and power supply unit configured to drive the LED light source assembly and provide electrical power for the LED lighting device. The device also includes a heat sink including the heat sink body and a heat sink covering, where the heat sink covering has an opening; and a plane including the highest point of the top of the heat sink body is higher than a plane including the opening of the heat sink covering. Further, the device includes a radio frequency (RF) antenna installed on periphery of the heat sink body. A plane that includes the highest point of the RF antenna is at the same level or lower
(Continued)

than the plane that includes the highest point of the top of the heat sink body.

20 Claims, 4 Drawing Sheets

(51) Int. Cl.

| | |
|---|---|
| ***F21V 23/04*** | (2006.01) |
| ***F21V 29/503*** | (2015.01) |
| ***F21K 9/232*** | (2016.01) |
| ***F21V 29/74*** | (2015.01) |
| ***F21K 9/238*** | (2016.01) |
| ***F21K 9/237*** | (2016.01) |
| ***F21V 1/00*** | (2006.01) |
| ***F21V 23/02*** | (2006.01) |
| ***H01Q 1/00*** | (2006.01) |
| ***H05B 37/02*** | (2006.01) |
| *F21Y 115/10* | (2016.01) |

(52) U.S. Cl.
CPC ..... *F21V 1/00* (2013.01); *F21V 3/00* (2013.01); *F21V 23/02* (2013.01); *F21V 23/0435* (2013.01); *F21V 29/503* (2015.01); *F21V 29/74* (2015.01); *H01Q 1/007* (2013.01); *H05B 37/0272* (2013.01); *F21Y 2115/10* (2016.08)

(56) References Cited

U.S. PATENT DOCUMENTS

| | | | | |
|---|---|---|---|---|
| 2012/0293652 | A1* | 11/2012 | Farmer | F21V 29/20 348/143 |
| 2013/0136454 | A1* | 5/2013 | Yu | H05B 33/0803 398/106 |
| 2013/0285544 | A1* | 10/2013 | Molezion | H01Q 1/007 315/34 |
| 2017/0142812 | A1* | 5/2017 | Creemers | H05B 37/0272 |

FOREIGN PATENT DOCUMENTS

| | | | |
|---|---|---|---|
| CN | 203810121 | U | 9/2014 |
| CN | 104566027 | A | 4/2015 |

* cited by examiner

LED LIGHTING DEVICE AND SYSTEM, AND ANTENNA ARRANGEMENT METHOD

CROSS-REFERENCES TO RELATED APPLICATIONS

This application is a national stage application under 35 USC § 371(c) of PCT Application No. PCT/CN2015/093000, entitled "LED Lighting Device and System, and Antenna Arrangement Method," filed on Oct. 28, 2015, which claims priority to Chinese Patent Application No. 201410829527.5, filed on Dec. 26, 2014. The entire disclosure and contents of the above applications are hereby incorporated by reference herein.

FIELD OF THE INVENTION

The present disclosure generally relates to light emitting diode (LED) lighting technology and, more particularly, relates to an LED lighting device and system, and an antenna arrangement method.

BACKGROUND

Light emitting diode (LED) is a solid state semiconductor device that can convert electrical energy into visible light. The LED can directly convert electricity into light. LED lighting may generally provide advantages in energy conservation, environmental protection, controllable lighting, solid state lighting, and long operational lifetime. LED lamps thus have been widely used in various areas for public, commercial, and/or indoor lighting in low carbon life style living.

With the development of smart technologies, LED lighting devices also become increasingly intelligent. In a smart home, an LED lighting device is connected to various smart terminal devices in a home environment or a public environment through network technology, achieving a centralized lighting control. Therefore, the user's smart environment experience is improved and a comfortable living environment is provided. In order to achieve intelligent control for the LED lighting devices, the network connection technology is particularly important. Currently, the network technology mainly includes two types: fixed wire network technology and wireless network technology. The most widely used wireless network transmission technology may be Wireless Fidelity (Wi-Fi) technology. Comparing to a fixed wire network, a wireless network can achieve data communication and smart device control in any place. Therefore, the wireless network technology is widely used in the LED lighting devices.

An antenna is a converter that can convert guided waves on a transmission line into electromagnetic waves, and vice versa. An antenna of a wireless device has a certain distance limitation. When the distance exceeds the distance limitation, an external antenna is needed to enhance a wireless signal, thus extending the transmission distance. Wireless control is the development trend of the smart LED lighting devices. Antenna designs can directly affect quality and stability of radio signals. As requirements for product structure and performance increase, the requirements for antenna designs also increase. Therefore, there is a need to provide an LED lighting device with compact structure and stable performance to meet the needs of current technology development.

The disclosed LED lighting devices and systems, and antenna arrangement methods are directed to solve one or more problems set forth above and other problems.

BRIEF SUMMARY OF THE DISCLOSURE

One aspect of the present disclosure includes a light emitting diode (LED) lighting device. The device includes an LED light source assembly installed on the top of a heat sink body, and an LED driving and power supply unit configured to drive the LED light source assembly and provide electrical power for the LED lighting device. The device also includes a heat sink including the heat sink body and a heat sink covering, where the heat sink covering has an opening; the heat sink body protrudes from the opening of the heat sink covering along a central axis of the heat sink covering; and a plane including the highest point of the top of the heat sink body is higher than a plane including the opening of the heat sink covering. Further, the device includes a radio frequency (RF) antenna installed on periphery of the heat sink body, where a space exists between the RF antenna and an inner wall of the heat sink covering, a plane including the highest point of the RF antenna is not higher than the plane including the highest point of the top of the heat sink body, the plane including the highest point of the RF antenna is not lower than the plane including the opening of the heat sink covering; and the RF antenna does not affect a lighting path of the LED light source assembly.

Another aspect of the present disclosure includes a light emitting diode (LED) lighting system. The system includes at least one LED lighting device. The device includes an LED light source assembly installed on the top of a heat sink body, and an LED driving and power supply unit configured to drive the LED light source assembly and provide electrical power for the LED lighting device. The device also includes a heat sink including the heat sink body and a heat sink covering, where the heat sink covering has an opening; the heat sink body protrudes from the opening of the heat sink covering along a central axis of the heat sink covering; and a plane including the highest point of the top of the heat sink body is higher than a plane including the opening of the heat sink covering. Further, the device includes a radio frequency (RF) antenna installed on periphery of the heat sink body, where a space exists between the RF antenna and an inner wall of the heat sink covering, a plane including the highest point of the RF antenna is not higher than the plane including the highest point of the top of the heat sink body, the plane including the highest point of the RF antenna is not lower than the plane including the opening of the heat sink covering; and the RF antenna does not affect a lighting path of the LED light source assembly. The system also includes a terminal configured to wirelessly control and communicate with the at least one LED lighting device.

Another aspect of the present disclosure includes a method for arranging an antenna of a light emitting diode (LED) lighting device. The method includes constituting a heat sink of the LED lighting device by a heat sink covering and a heat sink body, where the heat sink covering has an opening, and the heat sink body protrudes from the opening of the heat sink covering. The method also includes arranging a plane including the highest point of the top of the heat sink body higher than a plane including the opening of the heat sink covering and arranging a plane including the highest point of the RF antenna not higher than the plane including the highest point of the top of the heat sink body. Further, the method includes arranging the plane including the highest point of the RF antenna not lower than the plane including the opening of the heat sink covering.

Other aspects of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Reference will now be made in detail to exemplary embodiments of the disclosure, which are illustrated in the accompanying drawings. Wherever possible, the same reference numbers will be used throughout the drawings to refer to the same or like parts.

Figure 1:
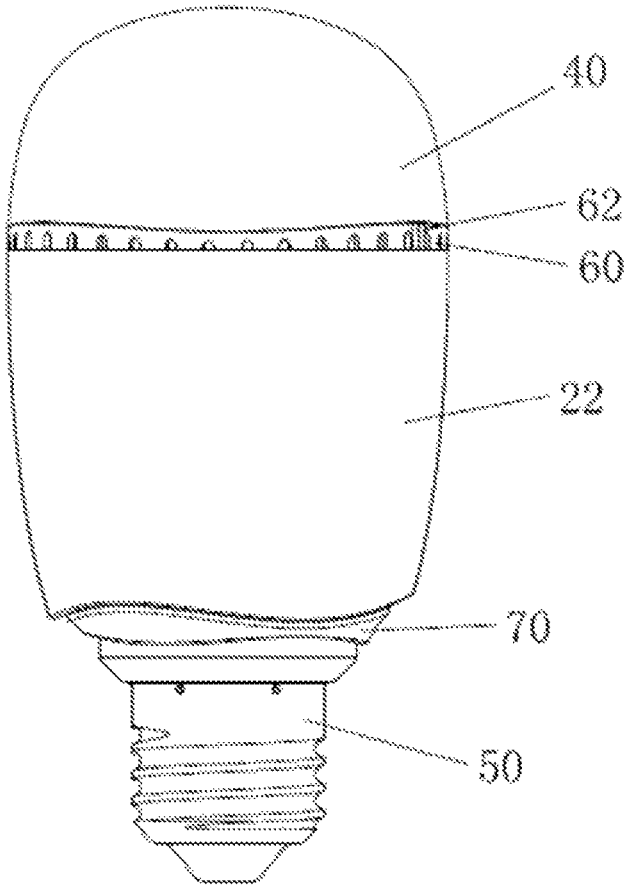
FIG. 1 illustrates a structure diagram of an exemplary LED lighting device consistent with the disclosed embodiments.
Figure 2:
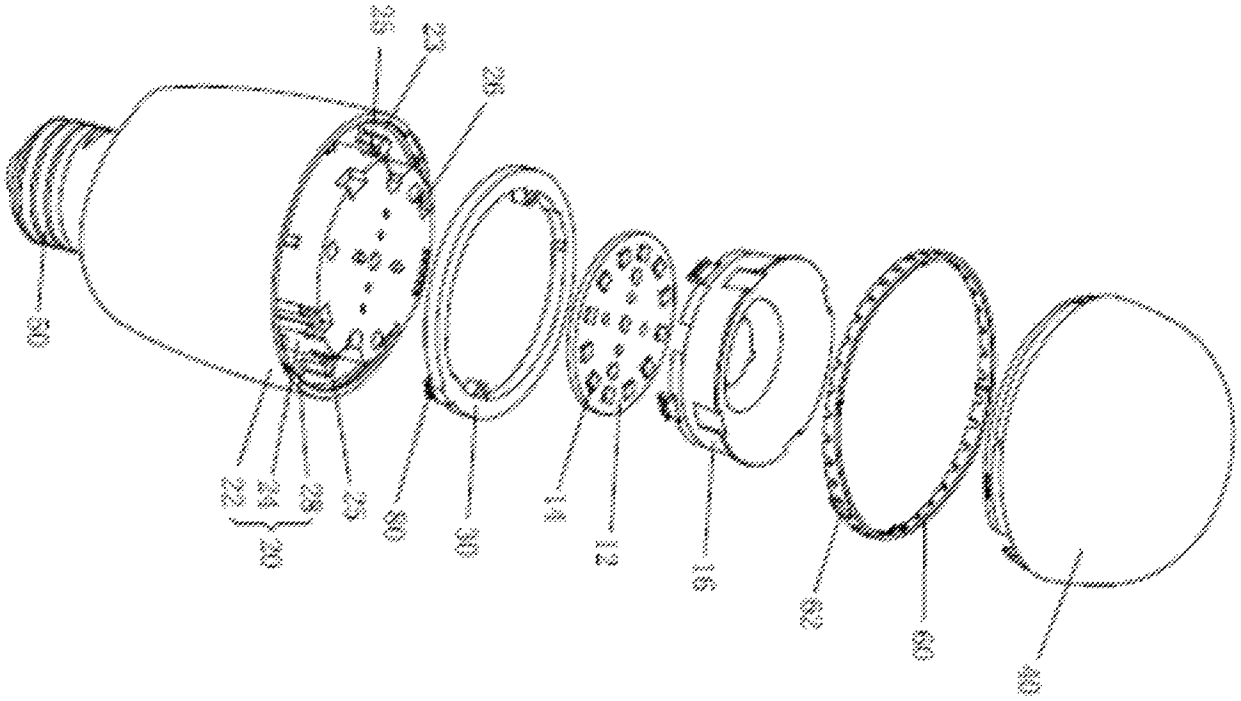
FIG. 2 illustrates another structure diagram of an exemplary LED lighting device consistent with the disclosed embodiments.

FIG. 1 illustrates a structure diagram of an exemplary LED lighting device consistent with the disclosed embodiments. FIG. 2 illustrates a breakdown structure diagram of an exemplary LED lighting device consistent with the disclosed embodiments. As shown in FIG. 1 and FIG. 2, the LED lighting device may include a lampshade 40, an LED driving and power supply unit (not shown), an LED light source assembly, a heat sink 20, a control module (not shown), a RF antenna 30, a plastic seat 70, and a lighting base 50. The lighting base 50 may be configured to connect electrically the LED lighting device to an external lighting holder. The plastic seat 70 is sleeved inside the heat sink 20 and is located between the heat sink 20 and the lighting base 50. The plastic seat 70 has a hollow structure containing the LED driving and power supply unit and the control module. The LED driving and power supply unit is connected to the lighting base 50 and the control module. The LED driving and power supply unit may be configured to drive the LED light source assembly and provide electrical power for the whole LED lighting device.

Specifically, the LED light source assembly may include an LED plate 12 installed on the heat sink 20, a lens 16 installed on the LED plate 12 and at least one LED light source 14 installed on the LED plate 12. The lens 16 transmits light and covers the LED light source 14. The lampshade 40 covers the LED light source assembly and is connected with a heat sink covering 22.

The heat sink 20 may include the heat sink covering 22, which has an opening 23, and a heat sink body 24 protruding outwardly along the opening 23 of the heat sink covering 22. The heat sink body 24 protrudes outwardly along a central axis of the heat sink covering 22. Optionally, a cross section of the LED lighting device is a round-shaped section, and a cross section corresponding to the heat sink covering 22 and the heat sink body 24 is a round-shaped section. A plurality of cooling fins 28 are circumferentially distributed along upper edge of the periphery of the heat sink body 24, such that a certain space between the heat sink body 24 and the heat sink covering 22 is formed, thus having a desirable cooling effect. The heat sink body 24, the heat sink covering 22 and the cooling fins 28 may be formed into one piece. Optionally, the heat sink 20 may use aluminum material. It should be understood that the heat sink 20 may use different thermal conductivity materials to form the heat sink covering 22 and the heat sink body 24, respectively. Because the heat sink body 24 axially protrudes from the opening of the heat sink covering 22, a plane including the highest point of the top of the heat sink body 24 may be higher than a plane including the opening 23 of the heat sink covering 22. The LED light source assembly is installed on the top of the heat sink body 24. The RF antenna 30 is installed on the periphery of the heat sink body 24 and there is a space between the RF antenna 30 and the inner wall of the heat sink covering 22.

Figure 3:
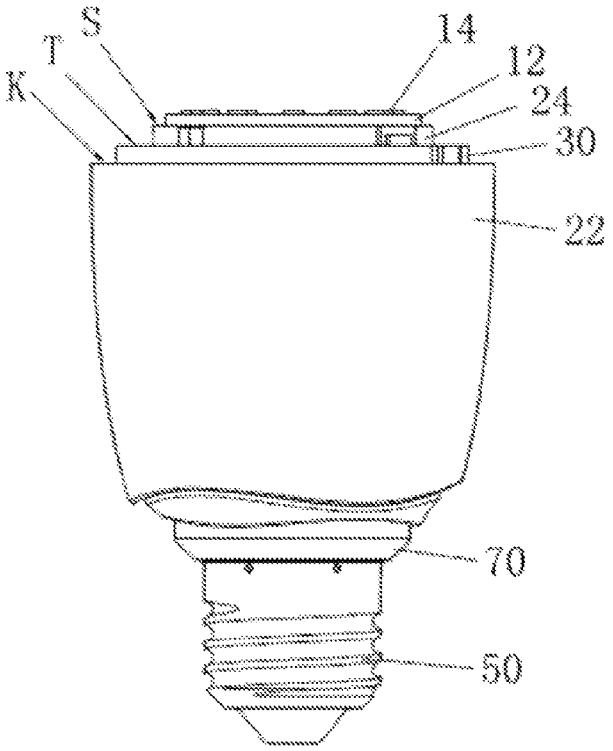
FIG. 3 illustrates another structure diagram of an exemplary LED lighting device consistent with the disclosed embodiments.

FIG. 3 illustrates a structure diagram of an exemplary LED lighting device consistent with the disclosed embodiments. As shown in FIG. 3, a plane T that includes the highest point of the RF antenna 30 is parallel to or is lower than a plane S that includes the highest point of the top of the heat sink body 24. The plane T that includes the highest point of the RF antenna 30 is parallel to or is higher than a plane K that includes the opening 23 of the heat sink covering 22. Therefore, the RF antenna 30 can receive and send RF signals without obstructions and the RF antenna does not affect a lighting path of the LED light source.

Figure 4:
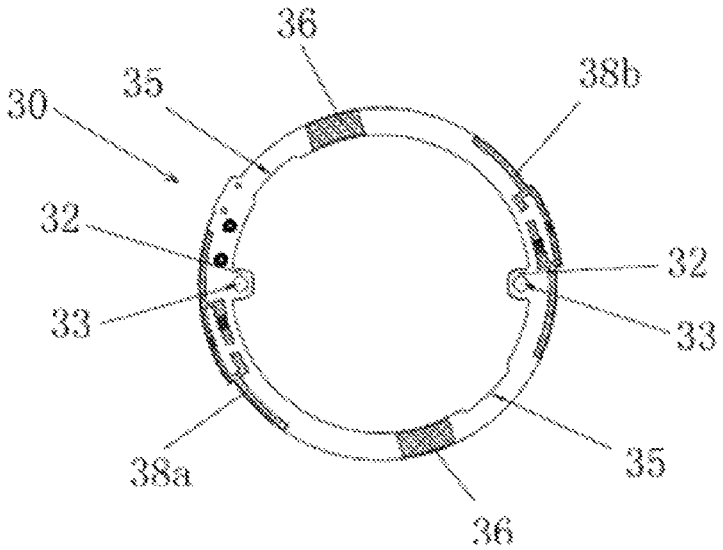
FIG. 4 illustrates a structure diagram of an exemplary radio frequency (RF) antenna consistent with the disclosed embodiments.
Figure 5:
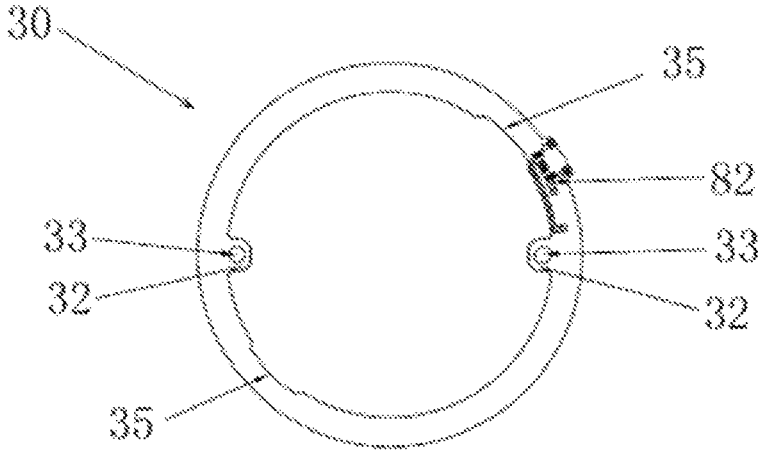
FIG. 5 illustrates a structure diagram of another side of the RF antenna shown in FIG. 4 consistent with the disclosed embodiments.

FIG. 4 illustrates a structure diagram of an exemplary radio frequency (RF) antenna consistent with the disclosed embodiments. FIG. 5 illustrates a structure diagram of another side of the RF antenna shown in FIG. 4 consistent with the disclosed embodiments. As shown in FIG. 4 and FIG. 5, the RF antenna 30 is a ring-shaped antenna. The RF antenna 30 is sleeved and fixed on the periphery of the heat sink body 24. It should be understood that the RF antenna may also be an arc-shaped antenna, or the RF antenna may be designed to a functional shape based on the specific structure contour of the heat sink body 24 and the heat sink covering 22. At least one mounting platform 32 is set along the inner wall of the RF antenna 30, where the at least one mounting platform 32 is used to install and fix the RF antenna on the heat sink body 24. Accordingly, at least one mounting portion 25 corresponding to the at least one mounting platform 32 is set on the heat sink body 24. Further, at least one clamping portion which is used to clamp the RF antenna 30 with the periphery of the heat sink body 24 is set along the inner wall of the RF antenna 30. Optionally, two symmetrical mounting platforms 32 and two symmetrical clamping portions are set along the diameter direction on the RF antenna 30. The position of mounting portion 25 of the heat sink body 24 corresponds to the position of the mounting platform 32 of the RF antenna 30. The periphery of the heat sink body 24 is clamped with the clamping portion of the RF antenna 30. The mounting platform 32 and the clamping portion are arranged in different positions, so that the LED lighting device has a solid supporting structure. Moreover, the clamping portion is a notch 35. A corresponding protruding portion 26 is set on the periphery of the heat sink body 24. The notch 35 of the RF antenna 30 is clamped with the protruding portion 26 of the heat sink body 24. Optionally, the clamping portion may be designed as a protruding portion and the periphery of the heat sink body 24 is designed as a concave portion. The protruding portion of the RF antenna 30 is clamped with the concave portion of the heat sink body 24, thus providing an ideal fixing and supporting effect. Specifically, the mounting platform 32 of the RF antenna 30 and the mounting portion 25 of the heat sink body 24 have a screw hole 33, respectively. The RF antenna 30 is connected and fixed to the heat sink body 24 through the screw hole 33 by a screw.

Specifically, the RF antenna 30 is a two-sided printed circuit board (PCB) which is integrated with a radio-frequency circuit. The thickness of the PCB may be 2 to 4 mm. Optionally, the thickness of the PCB is 3 mm. The RF antenna 30 may be double antennas. The frequency of the RF antenna 30 may be 2.4G to 2.5G. The radio-frequency circuits 38*a* and 38*b* of the two antennas are symmetrically set at two ends of the PCB and are located at an upper plane of the PCB, which is higher than or parallel to a plane that includes the opening 23 of the heat sink covering 22. Optionally, two lead sheets 36 are set between the two radio-frequency circuits 38*a* and 38*b* on the side integrated with the radio-frequency circuit of the PCB. The lead sheets are configured to improve the radiating direction of the RF antenna 30. Therefore, the RF antenna 30 can receive and send the RF signals with a steady performance.

Referring to FIG. 5 and FIG. 2, the LED lighting device also includes the control module which may be configured to control the LED light source assembly and a reset button 80 which is electrically connected to the control module. The reset button 80 may be fixed on the RF antenna 30. Specifically, a welding circuit 82 of the reset button 80 may be set on the PCB. The welding circuit 82 may be located at the other side antenna 30, opposite to the side including the radio-frequency circuits 38*a* and 38*b*.

A ring-shaped enhancer 60 is sleeved between the lampshade 40 and the heat sink covering 22. A button 62 protruding from the heat sink covering 22 is set at a position corresponding to the reset button 80 on the enhancer 60. Because the reset button 80 is installed on the lower surface of the PCB of the RF antenna 30, the position of the reset button 80 is lower than the position of the button 62 on the enhancer 60. Therefore, the button 62 on the enhancer 60 extends downward to form a connection with button 80, which can transmit a press effect of the button 62 to the reset button 80. In this disclosure, the PCB combines the RF antenna 30 and the reset button 80 together, thus saving space. Therefore, in embodiments of the present disclosure, the inner structure of the LED lighting device is more compact and reasonable.

Accordingly, an LED lighting system includes a plurality of LED lighting devices and a terminal configured to wirelessly control and communicate with the plurality of LED lighting devices. The terminal may be a mobile phone, a smart watch, and a laptop that have a wireless function. The terminal can intelligently control the LED lighting devices through the wireless connection.

Comparing to existing technologies, the heat sink 20 of the LED lighting device includes the heat sink body 24 and the heat sink covering 22. The heat sink body 24 is configured to install and support the LED light source assembly and contain the LED driving and power supply unit and other parts of the LED lighting device. The heat sink body 24 can transmit and dissipate heat produced by the parts contained on/in the heat sink body 24 in a timely manner. The heat sink covering 22 further enhances the heat dissipation effect. The LED light source assembly is installed on the top of the heat sink body 24. The RF antenna 30 is set on the periphery of the heat sink body 24. A plane that includes the highest point of the RF antenna 30 is parallel to or is lower than the plane that includes the highest point of the top of the heat sink body 24. Therefore, the lighting path of the LED light source assembly is not affected by the heat sink 20, ensuring the desired lighting effects. The RF antenna 30 is set on the periphery of the heat sink body 24, and there is a space between the RF antenna and the inner wall of the heat sink covering 22. Thus, the heat sink covering 22 can protect the structure of the RF antenna and the structure of the LED lighting device is more compact. In addition, because the plane that includes the highest point of the RF antenna 30 is parallel to or is higher than the plane that includes the opening 23 of the heat sink covering 22, the RF antenna 30 can protrude from the top of the heat sink covering 22. Therefore, the RF antenna 30 can receive and send RF signals without obstructions by the heat sink 20, which improves the quality and stability of the RF signals. The wireless control of the LED lighting devices consistent with the present disclosure can be more stable and more reliable.

The embodiments disclosed herein are exemplary only. Other applications, advantages, alternations, modifications, or equivalents to the disclosed embodiments are obvious to those skilled in the art and are intended to be encompassed within the scope of the present disclosure.

INDUSTRIAL APPLICABILITY AND ADVANTAGEOUS EFFECTS

Without limiting the scope of any claim and/or the specification, examples of industrial applicability and certain advantageous effects of the disclosed embodiments are listed for illustrative purposes. Various alternations, modifications, or equivalents to the technical solutions of the disclosed embodiments can be obvious to those skilled in the art and can be included in this disclosure.

In some embodiments consistent with the present disclosure, a user terminal may control the LED lighting device and the RF antenna of the LED lighting device by using the reset button 80. A user may control the LED lighting device and the RF antenna of the LED lighting device by using the button 62. For example, a user may manually turn the LED lighting device on or off by using button 62 (e.g., by pushing down once on button 62). A user may also manually turn the RF antenna of the LED lighting device on or off by using button 62 (e.g., by pushing down twice on button 62). The user terminal may control the LED lighting device and/or the RF antenna by controlling the LED driving unit and the RF antenna.

In some embodiments consistent with the present disclosure, sensors can be attached to the LED lighting device. The LED lighting device may be managed according to various data collected from the sensors. For example, a thermal sensor attached to the LED lighting device may provide data to the LED driving unit. The data may indicate that the LED lighting device is overheating. The LED driving unit may turn off the RF antenna (e.g., through reset button 88) for a period of time to reduce the heat production. Once the data from the thermal sensor indicates the LED device is of a normal temperature, the LED driving unit may turn the RF antenna (e.g., through reset button 88) back on. Based on data from the thermal sensor, when the LED lighting device is close to be overheated, the LED driving unit may change the brightness level, the color, or a combination of the two, to indicate the overheating. The LED driving unit may also control the LED lighting sources 14 to flash at a frequency to indicate overheating.

In another example, if the thermal sensor data indicate that the LED lighting device is overheated, the LED driving unit may turn off some or all of the LED light sources 14 to prevent the LED lighting device from being burned out. The LED driving unit may turn the some or all of the LED light sources 14 back on when the device has cooled down. Further, for example, if the RF antenna 30 is being used with other smart appliances (e.g., communicating with a router, a smart TV, a home security system, an air conditioning system, etc.), when the LED lighting device is getting close to be overheating (based on the thermal sensor data), a terminal may wirelessly control the LED lighting device to turn off all LED light sources 14 to prevent the LED lighting device from being burned out, while leaving the RF antenna 30 operational using reset button 80. In this case, based on data from the thermal sensor, when the LED lighting device is close to be overheated, the LED driving unit may change the brightness level, the color, or a combination of the two, to indicate the overheating. The LED driving unit may also control the LED light sources 14 to flash at a frequency to indicate overheating. A user may then turn off all LED light sources 14 to prevent the LED lighting device from being burned out, while leaving the RF antenna 30 operational using button 62. For example, the user may push down on button 62 three times to turn off some or all LED light sources 14, then hold down button 62 for a pre-set time, e.g., 1 second, to turn on/off antenna 30.

Comparing with the existing technology, in embodiments consistent with the present disclosure, in an LED lighting device, the heat sink body can transmit and dissipate heat produced by the parts contained in the heat sink body in a timely manner. The heat sink covering further enhances the heat dissipation effect. The heat sink covering can protect the structure of the RF antenna and the structure of the LED lighting device is more compact. The RF antenna can receive and send RF signals without obstructions by the heart sink, improving the quality and stability of the RF signals sent and received by the RF antenna.

REFERENCE SIGN LIST

Light emitting diode (LED) plate 12

LED light source 14

Lens 16

Heat sink 20

Heat sink body 22

Opening of heat sink covering 23

Heat sink covering 24

Mounting portion 25

Protruding portion 26

Radio frequency (RF) antenna 30

Mounting platform 32

Screw hole 33

Notch 35

Radio-frequency circuits 38*a* and 38*b*

Lampshade 40

Lighting base 50

Plastic seat 70

What is claimed is:

1. A light emitting diode (LED) lighting device, comprising:

an LED light source assembly installed on a top plane of a heat sink body;

an LED driving and power supply unit configured to drive the LED light source assembly and provide electrical power for the LED lighting device;

a heat sink including the heat sink body and a heat sink covering, wherein:

the heat sink covering has an opening;

the heat sink body protrudes from the opening of the heat sink covering along a central axis of the heat sink covering; and a radio frequency (RF) antenna installed and sleeved onto periphery of the heat sink body so that the RF antenna surrounds a lateral surface of the heat sink body, wherein:

a clearance exists between the RF antenna sleeved onto the heat sink body and an inner wall of the heat sink covering;

a top plane including a highest point of the RF antenna is not higher than the top plane of the heat sink body on which the LED light source assembly is disposed so that the RF antenna does not obstruct a lighting path of the LED light source assembly; and the top plane including the highest point of the RF antenna is not lower than a top plane including the opening of the heat sink covering so that the RF antenna receives and sends RF signals without obstructions from the heat sink body and the heat sink covering.

2. The device according to claim 1, wherein:

a plurality of cooling fins are circumferentially distributed along an upper edge of the periphery of the heat sink body.

3. The device according to claim 2, wherein:

the heat sink body, the heat sink covering, and the cooling fins are formed in one piece.

4. The device according to claim 1, wherein:

the RF antenna is a ring-shaped antenna.

5. The device according to claim 4, wherein:

a cross section of the heat sink body and the heat sink covering are round-shaped sections.

6. The device according to claim 5, wherein:

at least one mounting platform is set along the inner wall of the RF antenna, where the mounting platform is used to install and fix the RF antenna on the heat sink body; and at least one mounting portion is set on the heat sink body corresponding to the at least one mounting platform of the RF antenna.

7. The device according to claim 6, wherein:

at least one clamping portion, set along the inner wall of the RF antenna, is configured to clamp the RF antenna with the periphery of the heat sink body.

8. The device according to claim 7, wherein:

two symmetrical mounting platforms and two symmetrical clamping portions are set along a diameter direction of the RF antenna;

the mounting portions of the heat sink corresponds to the mounting platforms of the RF antenna; and the periphery of the heat sink body is clamped with the clamping portions of the RF antenna.

9. The device according to claim 7, wherein:
the clamping portion is a notch;
a corresponding protruding portion is set on the periphery of the heat sink body; and
the notch of the RF antenna is clamped with the protruding portion of the heat sink body.

10. The device according to claim 7, wherein:
the clamping portion is a protruding portion;
a corresponding concave portion is set on the periphery of the heat sink body; and
the protruding portion of the RF antenna is clamped with the concave portion of the heat sink body.

11. The device according to claim 6, wherein:
screw holes are set respectively on the mounting platform of the RF antenna and the mounting portion of the heat sink body; and
the RF antenna is fixed to the heat sink body through the screw holes.

12. The device according to claim 4, wherein:
the RF antenna is a printed circuit board (PCB) integrated with a radio-frequency circuit.

13. The device according to claim 12, further including:
a control module configured to control the LED light source assembly; and
a reset button electrically connected to the control module, where a welding circuit for the reset button is set on the PCB.

14. The device according to claim 12, wherein:
a thickness of the PCB is between 2 mm and 4 mm.

15. The device according to claim 12, wherein:
the RF antenna is double antennas;
radio-frequency circuits of the two antennas are symmetrically located at two ends of the PCB;
the radio-frequency circuits of the two antennas are located at an upper plane of the PCB; and
the upper plane of the PCB is at a same level or higher than the plane including the opening of the heat sink covering.

16. The device according to claim 1, wherein:
the LED light source assembly includes an LED plate and at least one LED light source set on the LED plate.

17. The device according to claim 16, wherein:
the LED light source assembly includes a lens that transmits light; and
the lens covers the LED light source.

18. The device according to claim 17, further including:
a lampshade covering the LED light source assembly and clamped with the heat sink covering.

19. A light emitting diode (LED) lighting system, comprising:
at least one LED lighting device, including:
an LED light source assembly installed on a top plane of a heat sink body;
an LED driving and power supply unit configured to drive the LED light source assembly and provide electrical power for the LED lighting device;
a heat sink including the heat sink body and a heat sink covering, wherein:
the heat sink covering has an opening;
the heat sink body protrudes from the opening of the heat sink covering along a central axis of the heat sink covering; and
a radio frequency (RF) antenna installed and sleeved onto periphery of the heat sink body so that the RF antenna surrounds a lateral surface of the heat sink body, wherein:
a clearance exists between the RF antenna sleeved onto the heat sink body and an inner wall of the heat sink covering;
a top plane including a highest point of the RF antenna is at a same level or lower than the top plane of the heat sink body on which the LED light source assembly is disposed so that the RF antenna does not obstruct a lighting path of the LED light source assembly; and
the top plane including the highest point of the RF antenna is not lower than a top plane including the opening of the heat sink covering so that the RF antenna receives and sends RF signals without obstructions from the heat sink body and the heat sink covering; and
a terminal configured to wirelessly control and communicate with the at least one LED lighting device.

20. A method for arranging an antenna of a light emitting diode (LED) lighting device, comprising:
forming a heat sink of the LED lighting device including a heat sink covering and a heat sink body, wherein the heat sink covering has an opening, and the heat sink body protrudes from the opening of the heat sink covering;
installing an LED light source assembly on a top plane of the heat sink body;
installing and sleeving a radio frequency (RF) antenna onto periphery of the heat sink body so that the RF antenna surrounds a lateral surface of the heat sink body, and a clearance exists between the RF antenna sleeved onto the heat sink body and an inner wall of the heat sink covering;
arranging a top plane that includes a highest point of the RF antenna to be not higher than the top plane of the heat sink body on which the LED light source assembly is disposed so that the RF antenna does not obstruct a lighting path of the LED light source assembly; and
arranging the top plane that includes the highest point of the RF antenna at a same level or higher than a top plane that includes the opening of the heat sink covering so that the RF antenna receives and sends RF signals without obstructions from the heat sink body and the heat sink covering.

* * * * *